US007453209B2

(12) United States Patent
Kweon et al.

(10) Patent No.: US 7,453,209 B2
(45) Date of Patent: Nov. 18, 2008

(54) PLASMA DISPLAY PANEL HAVING PAIRS OF ADDRESS ELECTRODES BETWEEN SCAN AND SUSTAIN ELECTRODES

(75) Inventors: Tae-Joung Kweon, Suwon-si (KR); Kyoung-Doo Kang, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 92 days.

(21) Appl. No.: 11/407,548

(22) Filed: Apr. 19, 2006

(65) Prior Publication Data

US 2006/0267496 A1 Nov. 30, 2006

(30) Foreign Application Priority Data

May 25, 2005 (KR) ..... 10-2005-0044018

(51) Int. Cl.
*H01J 17/00* (2006.01)

(52) U.S. Cl. ..... 313/585; 313/581; 313/584; 313/586

(58) Field of Classification Search ..... 313/581–587; 345/60; 445/24, 25
See application file for complete search history.

(56) References Cited

U.S. PATENT DOCUMENTS 5,438,236 A * 8/1995 Evans ..... 313/582
5,744,909 A * 4/1998 Amano ..... 313/585
6,069,446 A * 5/2000 Kim ..... 313/582
6,188,374 B1 * 2/2001 Moon ..... 345/60
7,196,470 B2 * 3/2007 Yoo et al. ..... 313/582
2002/0175623 A1 * 11/2002 Kim et al. ..... 313/585
2003/0151363 A1 * 8/2003 Lee et al. ..... 313/587
2004/0027073 A1 * 2/2004 Nomoto et al. ..... 313/583
2004/0169471 A1 * 9/2004 Bettinelli et al. ..... 313/582
2004/0178730 A1 * 9/2004 Shinoda et al. ..... 313/582
2004/0212305 A1 * 10/2004 Fujitani et al. ..... 313/586
2005/0116646 A1 * 6/2005 Yoo et al. ..... 313/582
2005/0242724 A1 * 11/2005 Kim et al. ..... 313/582

FOREIGN PATENT DOCUMENTS

KR 10-1997-0030098 * 6/1997

OTHER PUBLICATIONS

Lee et al., Korean Patent Application, 10-1997-00300098, Jun. 1997, machine_translation.*

* cited by examiner

*Primary Examiner*—Sikha Roy
*Assistant Examiner*—Tracie Y Green
(74) *Attorney, Agent, or Firm*—Christie, Parker & Hale, LLP

(57) ABSTRACT

A plasma display panel includes a first substrate and a second substrate with discharge cells partitioned therebetween. First electrodes and second electrodes surround the discharge cells and are respectively disposed proximate to opposite ones of the first and second substrates. The first electrodes are connected to each other and the second electrodes are connected to each other in a first direction. Address electrodes are between and spaced apart from the first and second electrodes along the direction perpendicular to the planes of the first substrate and the second substrate, and are connected in a second direction crossing the first direction. The address electrodes also surround the discharge cells.

18 Claims, 5 Drawing Sheets

PLASMA DISPLAY PANEL HAVING PAIRS OF ADDRESS ELECTRODES BETWEEN SCAN AND SUSTAIN ELECTRODES

CROSS-REFERENCE TO RELATED APPLICATION

This application claims priority to and the benefit of Korean Patent Application No. 10-2005-0044018, filed in the Korean Intellectual Property Office on May 25, 2005, the entire content of which is incorporated herein by reference.

BACKGROUND OF THE INVENTION

An example of a PDP is a three-electrode surface-discharge type of PDP. A three-electrode surface-discharge type PDP includes sustain electrodes, scan electrodes, and address electrodes. The sustain electrodes and the scan electrodes are parallel to each other on the same plane of a front substrate. The address electrodes are provided in a rear substrate in a direction crossing the sustain electrodes and the scan electrodes.

Barrier ribs are provided between the front substrate and the rear substrate, i.e., between the sustain electrodes and the scan electrodes and between the sustain electrodes and the address electrodes. In the barrier ribs, discharge cells are formed at portions where the sustain electrodes and the scan electrodes disposed in parallel cross the address electrodes. The discharge cells are filled with a discharge gas.

The PDP selects a turn-on discharge cell through an address discharge by a scan pulse applied to the scan electrodes and an address pulse applied to the address electrodes, and implements images through a sustain discharge by a sustain pulse that is alternately applied to sustain electrodes and scan electrodes of the selected discharge cell.

The PDP includes the sustain electrodes and the scan electrodes at the front of the discharge cells. Therefore, the PDP generates a plasma discharge at each inner surface of the sustain electrodes and the scan electrodes and diffuses the plasma discharge toward the rear substrate. The plasma discharge excites phosphors within the discharge cells to generate visible rays.

The sustain electrodes and the scan electrodes provided in the front substrate reduce the aperture ratio of the discharge cells and lower the transmittance of visible rays, which are generated within the discharge cells and directed toward the front substrate.

Therefore, the three-electrode surface-discharge type of PDP has low brightness or low luminous efficiency. If the PDP is used for a long period of time, charged particles of the discharge gas generate ion sputtering in the phosphors by way of an electric field. This may result in permanent after-images.

SUMMARY OF THE INVENTION

Various embodiments of the present invention have an improved aperture ratio of discharge cells or an improved transmittance of visible rays, and improved brightness and luminous efficiency.

Some embodiments of the present invention provide a PDP in which reactive power consumption between neighboring address electrodes and heat occurring in the address electrodes can be reduced.

Other embodiments of the present invention provide a PDP in which an addressing firing voltage is lowered, enabling an address discharge through a low voltage.

In some embodiments, each electrode is formed on the sides of the discharge cells between the front substrate and the rear substrate. Furthermore, the charge particles of the discharge gas are directed toward the center of the discharge cells during the address discharge by the address electrodes and the scan electrodes and the sustain discharge by the sustain electrodes and the scan electrodes.

One embodiment of a plasma display panel (PDP) includes a first substrate and a second substrate disposed opposite to each other with a predetermined distance therebetween; a plurality of discharge cells partitioned between the first substrate and the second substrate; first electrodes surrounding discharge cells of the plurality of discharge cells and disposed proximate to one of the first substrate and the second substrate and between the first substrate and the second substrate, the first electrodes being connected in a first direction; and second electrodes spaced apart from the first electrodes along a direction perpendicular to planes of the first substrate and the second substrate and connected in the first direction. The second electrodes surround discharge cells of the plurality of discharge cells and are disposed proximate to the other of the first substrate and the second substrate. A plurality of address electrodes, which are spaced apart from the first electrodes and the second electrodes are between the first electrodes and the second electrodes along the direction perpendicular to the planes of the first substrate and the second substrate, the plurality of address electrodes connected in a second direction crossing the first direction. The address electrodes surround discharge cells of the plurality of discharge cells.

In one embodiment, the plurality of address electrodes includes first address electrodes disposed proximate to the first electrodes; and second address electrodes spaced apart from the first address electrodes and disposed proximate to the second electrodes. In another embodiment, in a cross-section along the direction perpendicular to the planes of the first substrate and the second substrate each of the first electrodes, the second electrodes, the first address electrodes, and the second address electrodes has a first side and a second side having a rectangular cross-sectional shape; a length of each of the first sides of the first electrodes, the second electrodes, the first address electrodes, and the second address electrodes is the same; and a length of each of the second sides of the first address electrodes and the second address electrodes is shorter than that of each of the second sides of the first electrodes and the second electrodes.

In yet another embodiment, a sum of the length of the second sides of the first address electrodes and the length of the second sides of the second address electrodes is smaller than the length of the second sides of the first electrodes or second sides of the second electrodes.

In a cross-section of another embodiment along the direction perpendicular to the planes of the first substrate and the second substrate, a cross-sectional area of each of the first address electrodes and the second address electrodes is smaller than a cross-sectional area of each of the first electrodes and the second electrodes. In another embodiment, the sum of a cross-sectional area of the first address electrodes and a cross-sectional area of the second address electrodes is smaller than a cross-sectional area of the first electrodes or a cross-sectional area of the second electrodes.

The first address electrodes and the second address electrodes may have a same shape. In one embodiment, each of the first electrodes and the second electrodes includes: circular members surrounding the discharge cells; and connecting members that connect the circular members in the first direction. The address electrodes may include circular members surrounding the discharge cells; and connecting members that connect the circular members in the second direction. The circular members of the first electrodes, the circular members of the plurality of address electrodes, and the circular members of the second electrodes may be spaced apart from one another in parallel along the direction perpendicular to the planes of the first substrate and the second substrate.

In one embodiment, the first electrodes, the second electrodes, and the plurality of address electrodes are formed of a metal electrode. The first electrodes, the second electrodes, and the plurality of address electrodes may be buried within a dielectric layer, and the dielectric layer may be covered with protective layers on an inner surface of the discharge cells.

In another embodiment, the plurality of discharge cells are partitioned by a barrier rib layer disposed between the first substrate and the second substrate; and an electrode layer formed of a dielectric layer surrounds the first electrodes, the plurality of address electrodes, and the second electrodes. The barrier rib layer may be formed in the second substrate; and the electrode layer may be disposed between the barrier rib layer and the first substrate. Additionally, the plurality of discharge cells may have a cylindrical shape corresponding to an arrangement of the first electrodes, the plurality of address electrodes, and the second electrodes. The PDP may further include phosphor layers formed inside of the plurality of discharge cells partitioned by the barrier rib layer, and the phosphor layers may be formed of a transmission type of phosphor.

One embodiment of an electrode layer for positioning between a first substrate and a second substrate in a plasma display panel, the electrode layer includes a dielectric material having a plurality of openings defining discharge cells; first electrodes respectively surrounding each of the discharge cells and disposed proximate to a first side of the dielectric layer, the first electrodes connected to each other in a first direction; second electrodes respectively surrounding each of the discharge cells and disposed proximate to a second side of the electrode layer, the second side opposite to the first side, the second electrodes connected in the first direction; and address electrodes respectively surrounding each of the discharge cells, the address electrodes positioned between and spaced apart from the first electrodes and the second electrodes and connected in a second direction crossing the first direction.

The address electrodes may include first address electrodes disposed proximate to the first electrodes; and second address electrodes spaced apart from the first address electrodes and disposed proximate to the second electrodes. Each of the first electrodes, the second electrodes, and the address electrodes may include a circular member surrounding a respective one of the discharge cells; and a connecting member that connects the circular member to an adjacent circular member.

DETAILED DESCRIPTION OF THE EMBODIMENTS

Figure 1:
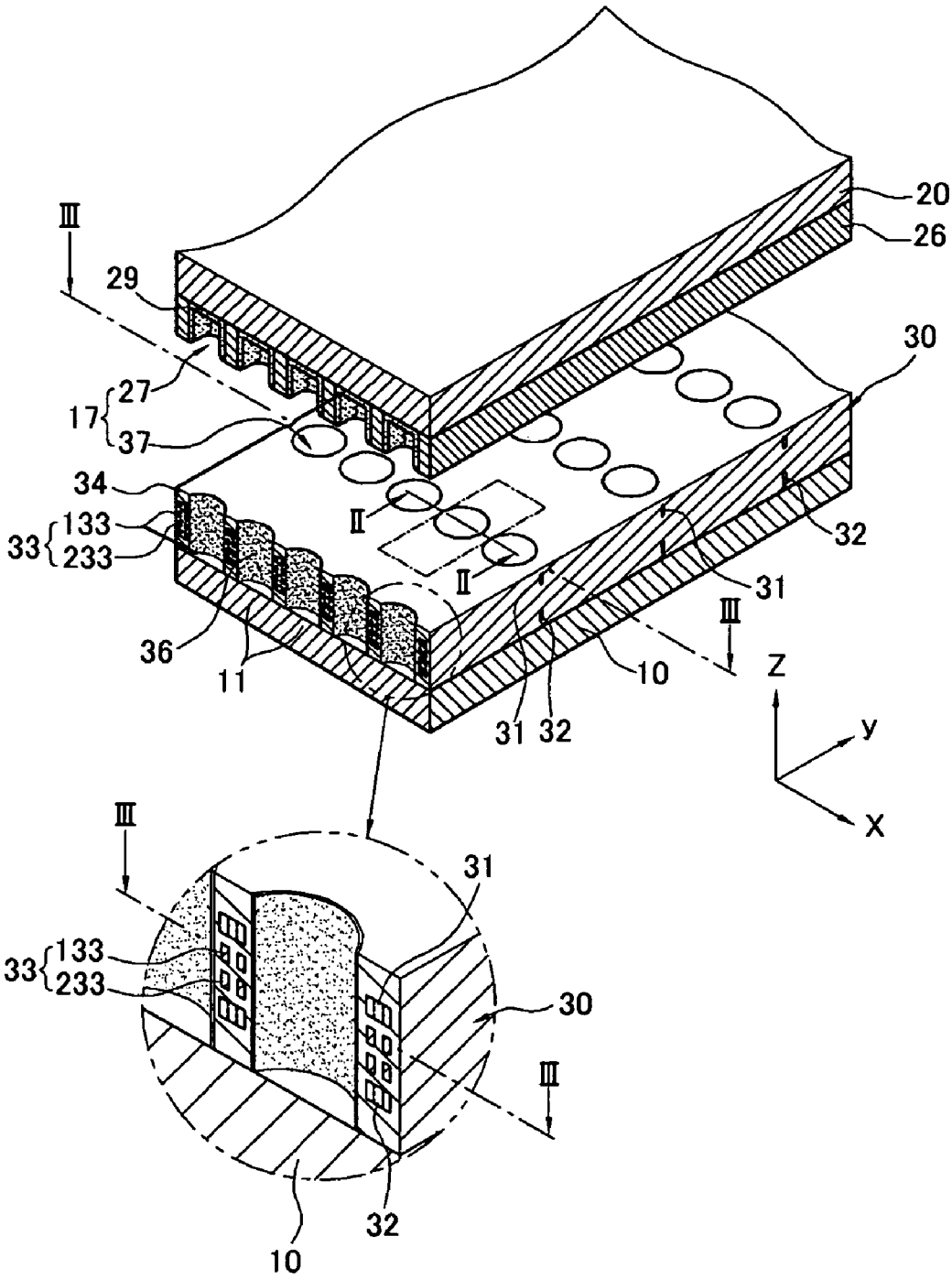
FIG. 1 is an exploded perspective view of a PDP according to an exemplary embodiment of the present invention.

Hereinafter, various embodiments of the invention will be described with reference to the accompanying drawings in order for those skilled in the art to be able to implement it. As those skilled in the art would realize, the described embodiments may be modified in various different ways, all without departing from the spirit or scope of the present invention. Wherever possible, the same reference numbers will be used throughout the drawing(s) to refer to the same or like parts.

Referring to FIG. 1, the PDP basically includes a first substrate (hereinafter referred to as a "rear substrate") 10 and a second substrate (hereinafter referred to as a "front substrate") 20, which are disposed opposite to each other with a predetermined distance therebetween, and a plurality of discharge cells 17 that are partitioned between the rear substrate 10 and the front substrate 20. The discharge cells 17 include first discharge cells 27 partitioned by a barrier rib layer 26, and second discharge cells 37 partitioned by an electrode layer 30 corresponding to the barrier rib layer 26.

Figure 2:
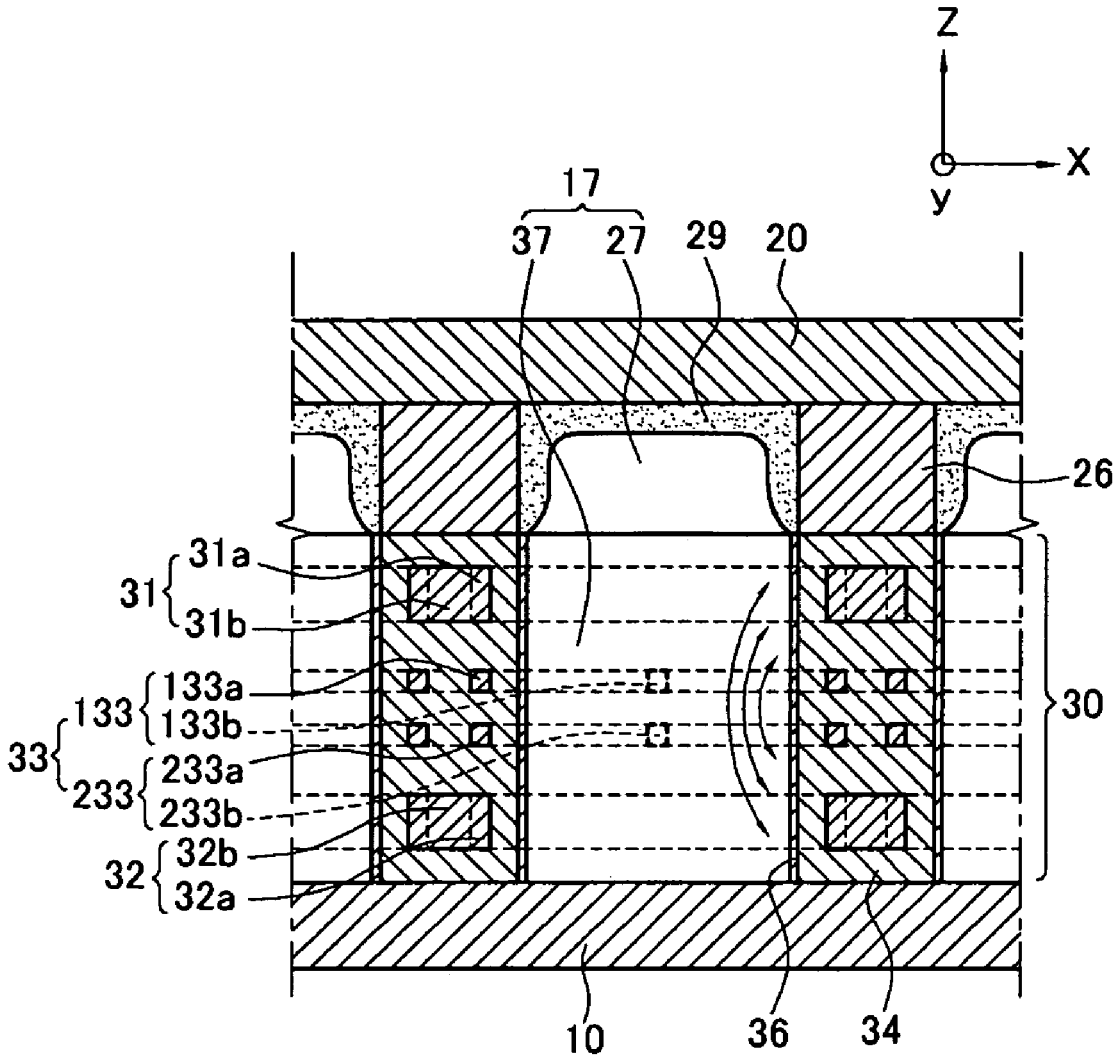
FIG. 2 is a cross-sectional view of the PDP taken along lines II-II in FIG. 1.

The barrier rib layer 26 partitions the plurality of first discharge cells 27 between the rear substrate 10 and the front substrate 20 (refer to FIG. 2). The barrier rib layer 26 can be formed on the front substrate 20 as in the present exemplary embodiment, or can be formed on the rear substrate 10. Furthermore, the barrier rib layer 26 can be separately or integrally formed on both the substrates 10 and 20 (not shown).

The barrier rib layer 26 can form the first discharge cells 27 in various shapes such as a square or hexagon (not shown). The present exemplary embodiment illustrates the first discharge cells 27 having a cylindrical shape (refer to FIG. 3). In the first discharge cells 27 having a cylindrical shape, a distance from the inner circumference to the center is made constant, enabling a uniform discharge within the first discharge cells 27.

The first discharge cells 27 include phosphor layers 29 that absorb vacuum ultraviolet (VUV) rays and emit visible rays. A discharge gas (e.g., a mixed gas containing neon (Ne) and xenon (Xe)) fills the discharge cells 17 so that VUV rays can be generated by a plasma discharge.

Furthermore, the discharge cells 17 can be formed by etching the inside surface of the rear substrate 10 or the front substrate 20, or can be formed by etching the inside surfaces of both the substrates 10 and 20 (not shown).

In this case, the barrier rib layer 26 can be formed using the same material as that of both the substrates 10 and 20. The above etching method can lower the processing cost in comparison with a method in which the barrier rib layers are separately provided in the substrates 10 and 20, respectively.

FIG. 2 is a cross-sectional view of the PDP taken along lines II-II in FIG. 1. An exemplary embodiment in which the barrier rib layer 26 is provided in the front substrate 20 will now be described with reference to FIG. 2.

The phosphor layers 29 are formed inside of the first discharge cells 27 formed by the barrier rib layer 26 and on the inside surface of the front substrate 20 forming the first discharge cells 27. The phosphor layers 29 are formed of a transmission type of phosphor that absorbs VUV rays generated from the first discharge cells 27 to generate visible rays and transmit the visible rays toward the front substrate 20.

Though not shown in the drawing, in the case where the phosphor layers are formed in the rear substrate 10, the phosphor layers can be formed of a reflection type of phosphor that absorbs VUV rays generated from the second discharge cells 37 to generate visible rays and transmit the visible rays toward the front substrate 20.

Furthermore, in the case where the phosphor layers are formed both in the front substrate 20 and the rear substrate 10, the phosphor layers of the front substrate 20 can be formed of a transmission type of phosphor, and the phosphor layers of the rear substrate 10 can be formed of a reflection type of phosphor.

The PDP of the present exemplary embodiment includes first electrodes (hereinafter referred to as "sustain electrodes") 31 and second electrodes (hereinafter referred to as "scan electrodes") 32, each corresponding to the discharge cells 17, and address electrodes 33 between the rear substrate 10 and the front substrate 20 in order to display images by generating VUV rays that will collide against the phosphor layers 29 through a plasma discharge. The address electrodes 33 include first address electrodes 133 and second address electrodes 233.

The PDP selects discharge cells 17 that will be turned on using an address discharge by the scan electrodes 32 and the address electrodes 33, and emits light in the selected discharge cells 17 using a sustain discharge by the sustain electrodes 31 and the scan electrodes 32.

To this end, the scan electrodes 32 apply a sustain pulse during the sustain discharge and apply a scan pulse during the address discharge. The sustain electrodes 31 apply a sustain pulse during the sustain discharge. The address electrodes 33 apply an address pulse during the address discharge. A driving waveform in which a corresponding pulse is applied to each electrode can be implemented in various ways, and can include a known driving waveform. A description thereof will be omitted.

The sustain electrodes 31, the scan electrodes 32, and the address electrodes 33 can play different roles depending on signal voltages applied thereto. It is to be understood that the relationship between the electrodes and the voltage signals is not limited to the above description.

The sustain electrodes 31, the scan electrodes 32, and the address electrodes 33 form the separate electrode layer 30, which is disposed between the substrates 10 and 20. Therefore, since the barrier rib layer 26 is formed in the front substrate 10, the electrode layer 30 is disposed between the barrier rib layer 26 and the rear substrate 10.

Furthermore, the sustain electrodes 31, the scan electrodes 32, and the address electrodes 33 can be thus formed of an opaque material since they do not degrade the front aperture ratio of the discharge cells 17. Therefore, the sustain electrodes 31, the scan electrodes 32, and the address electrodes 33 can be formed using a metal electrode with good electrical conductivity.

In the electrode layer 30, the sustain electrodes 31 are disposed close to the barrier rib layer 26 of the front substrate 20, the scan electrodes 32 are disposed close to the rear substrate 10, and the address electrodes 33 are disposed between the sustain electrodes 31 and the scan electrodes 32.

The electrode layer 30 forms the second discharge cells 37 that are integrally connected to the first discharge cells 27 formed in the front substrate 20. Therefore, the discharge cells 17 are substantially defined by the spaces of the first discharge cells 27 formed by the barrier rib layer 26 and spaces of the second discharge cells 37 formed by the electrode layer 30.

Figure 3:
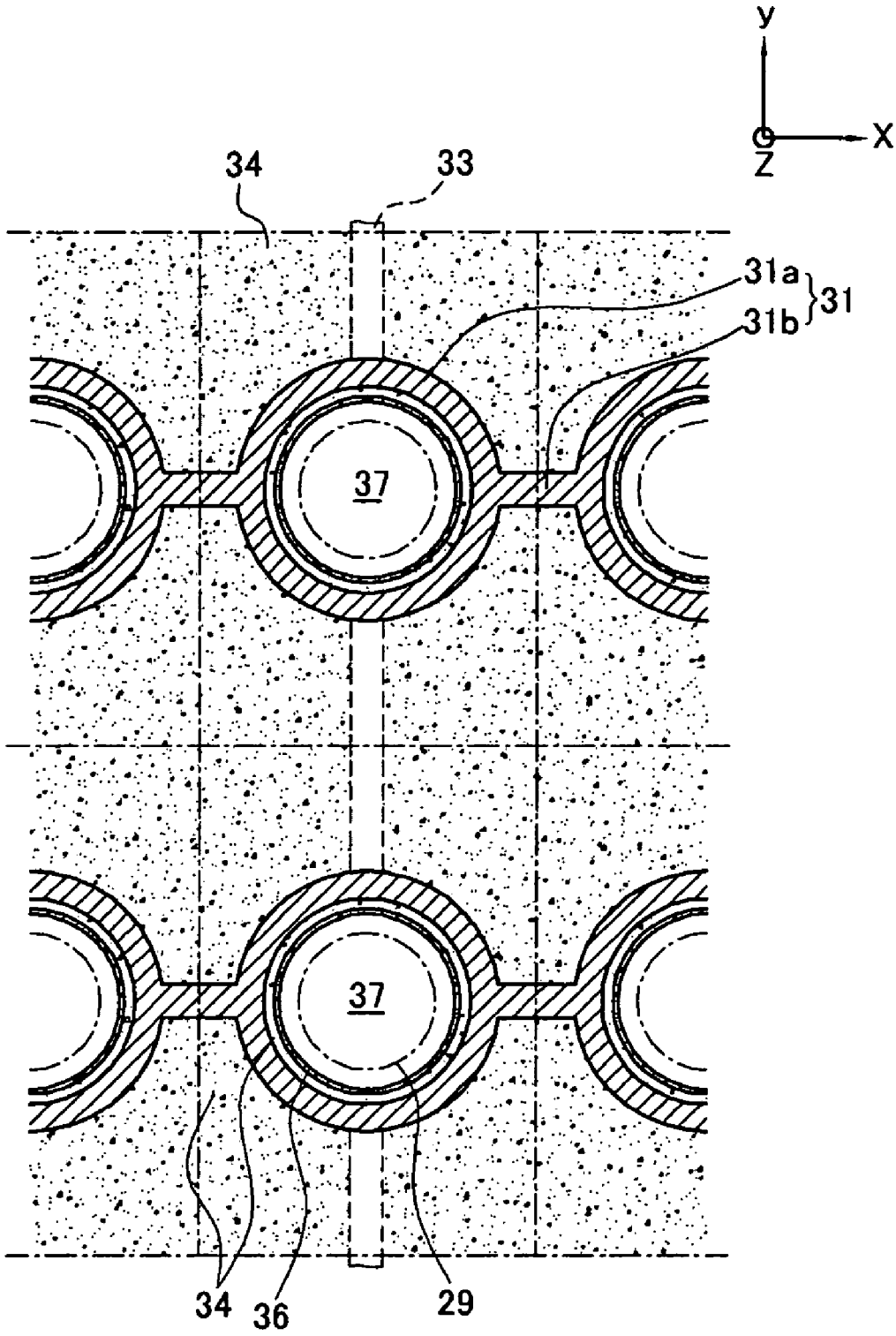
FIG. 3 is a cross-sectional view of the PDP taken along lines III-III in FIG. 1.
Figure 4:
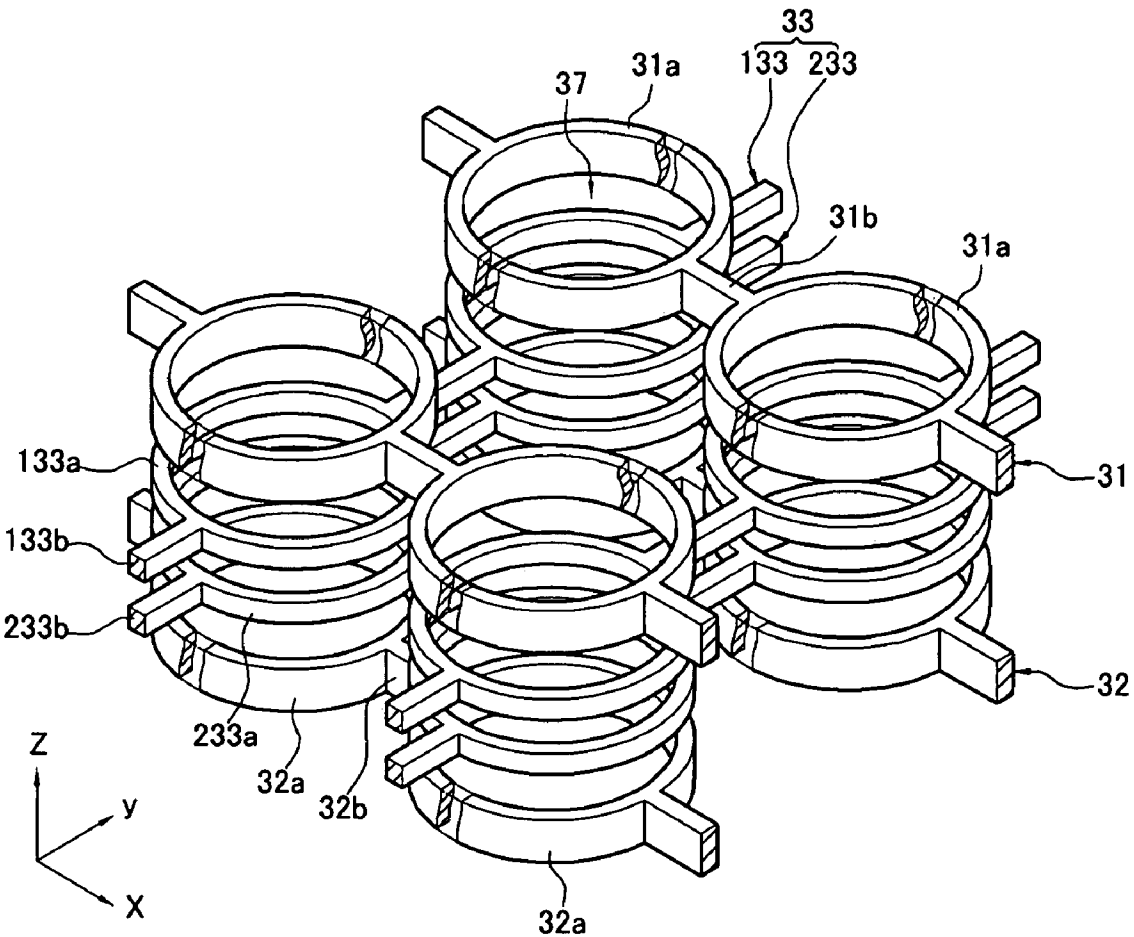
FIG. 4 is a perspective view showing one embodiment of a structure in which electrodes are arranged.

FIG. 3 is a cross-sectional view of the PDP taken along lines III-III in FIG. 1. FIG. 4 is a perspective view showing an embodiment of a structure in which electrodes are arranged.

The sustain electrodes 31, the scan electrodes 32 and the address electrodes 33 have a structure in which they surround the second discharge cells 37 connected to the first discharge cells 27 while corresponding to the respective first discharge cells 27.

In the electrode layer 30, the sustain electrodes 31 surround portions adjacent to the front substrate 20 of the second discharge cells 37 and are connected in one direction (an x-axis direction, as shown in the drawings). The sustain electrodes 31 correspond to consecutive second discharge cells 37 that are adjacent to each other along the x-axis direction. The plurality of sustain electrodes 31 is disposed in parallel along the y-axis direction while maintaining the same distance from the neighboring second discharge cells 37.

The scan electrodes 32 surround portions adjacent to the rear substrate 10 of the second discharge cells 37 and are connected along the x-axis direction. In the structure in which the sustain electrodes 31, the scan electrodes 32, and the address electrodes 33 surround the second discharge cells 37 connected to the first discharge cells 27 while corresponding to the first discharge cells 27, respectively, the scan electrodes 32 have the same structure as that of the sustain electrodes 31. The scan electrodes 32 are spaced apart from the sustain electrodes 31 in a direction vertical to the planes of both the substrates 10 and 20 (z-axis direction). The scan electrodes 32 consecutively correspond to the second discharge cells 37 that are adjacent in the x-axis direction. The plurality of scan electrodes 32 are disposed in parallel in the y-axis direction, while maintaining the same distance from the neighboring second discharge cells 37.

The address electrodes 33 are provided in plural between the sustain electrodes 31 and the scan electrodes 32 in a direction vertical to the planes of both the substrates 10 and 20 (the z-axis direction). It is to be noted that the present exemplary embodiment shown in FIGS. 1-5 illustrates the address electrode 33 having a first address electrode 133 and a second address electrode 233 for convenience of explanation.

The first address electrode 133 and the second address electrode 233 are spaced apart from each other in a direction vertical to the planes of both substrates 10 and 20 (the z-axis direction), and are also spaced apart from the sustain electrode 31 and the scan electrode 32. In this state, the first address electrode 133 is disposed adjacent to the sustain electrode 31 and the second address electrode 233 is disposed adjacent to the scan electrode 32.

The first address electrode 133 and the second address electrode 233 have the same shape and are applied with the same voltage signal (i.e., an address pulse of the same voltage).

In the structure in which the sustain electrodes 31, the scan electrodes 32, and the address electrodes 33 surround the second discharge cells 37 connected to the first discharge cells 27 while corresponding to the respective first discharge cells 27, the first address electrode 133 and the second address electrode 233 have the same structure. The first address electrode 133 and the second address electrode 233 correspond to consecutive ones of the second discharge cells 37 that are adjacent in the y-axis direction. That is, the connection direction (the y-axis direction) of the first address electrode 133 and the second address electrode 233 crosses the connection direction (the x-axis direction) of the scan electrodes 32. The plurality of address electrodes 33 are disposed in parallel in the x-axis direction while maintaining the distance of the neighboring second discharge cells 37. The discharge cells 17 can be selected as the address electrodes 33, and the scan electrodes 32 are disposed to cross each other.

The sustain electrodes 31, the scan electrodes 32, and the address electrodes 33 can be formed so that a plasma discharge is directed toward the center of the second discharge cells 37.

To this end, the sustain electrode 31 includes a circular member 31*a* and a connecting member 31*b*. The scan electrode 32 includes a circular member 32*a* and a connecting member 32*b*. The circular members 31*a* and 32*a* surround the second discharge cell 37 at their sides. The connecting members 31*b* of the sustain electrodes 31 connect the circular members 31*a* of the sustain electrodes 31 in the x-axis direction. The connecting members 32*a* of the scan electrodes 32 connect the circular members 32*a* of the scan electrodes 32 in the x-axis direction.

Furthermore, the first address electrode 133 includes a circular member 133*a* and a connecting member 133*b*, and the second address electrode 233 includes a circular member 233*a* and a connecting member 233*b*. The circular members 133*a* and 233*a* surround the second discharge cells 37 at their sides. The connecting members 133*b* of the first address electrode 133 connect the circular members 133*a* of the first address electrode 133 in the y-axis direction. The connecting members 233*b* of the second address electrode 233 connect the circular members 233*a* of the second address electrode 233 in the y-axis direction.

The circular members 31*a* of the sustain electrodes 31, the circular members 133*a* of the first address electrodes 133, the circular members 233*a* of the second address electrodes 233, and the circular members 32*a* of the scan electrodes 32 are spaced apart from one another in parallel in a direction vertical to the planes of the front substrate 20 and the rear substrate 10 (the z-axis direction).

The sustain electrodes 31, the scan electrodes 32, and the address electrodes 33 can be formed to have a structure in which a plasma discharge is possible at a low voltage.

Figure 5:
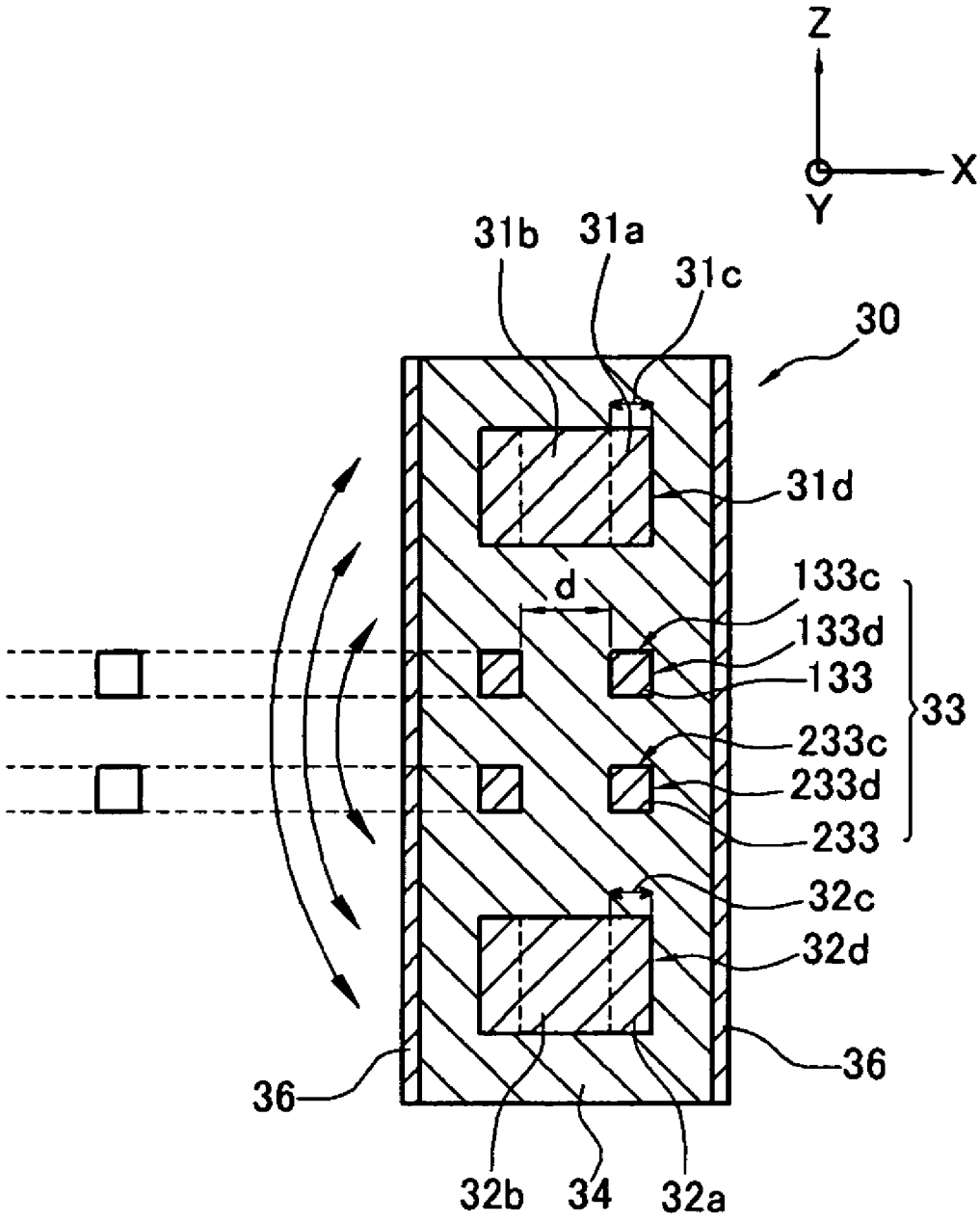
FIG. 5 is a partial cross-sectional view of the electrode layer shown in FIG. 2 for comparing cross-section area specifications of sustain electrodes, scan electrodes, first address electrodes, and second address electrodes.

FIG. 5 is a partial cross-sectional view of the electrode layer 30 shown in FIG. 2 for comparing the cross-section area specifications of the sustain electrodes, the scan electrodes, the first address electrodes, and the second address electrodes.

The cross-section is taken along a direction vertical to the planes of both the substrates 10 and 20 (the z-axis direction), the sustain electrode 31 has a horizontal side 31*c* and a vertical side 31*d* of a rectangular shape, and the scan electrode 32 has a horizontal side 32*c* and a vertical side 32*d* of a rectangular shape. The first address electrode 133 has a horizontal side 133*c* and a vertical side 133*d* of a rectangular shape, and the second address electrode 233 has a horizontal side 233*c* and a vertical side 233*d* of a rectangular shape.

In the sustain electrode 31, the scan electrode 32, the first address electrode 133, and the second address electrode 233, the horizontal sides 31*c*, 32*c*, 133*c*, and 233*c* have the same length.

The vertical side 31*d* of the sustain electrode 31 and the vertical side 32*d* of the scan electrode 32, which generate a sustain discharge, have the same length so that the sustain discharge is generated at the center without inclining to one side. The vertical sides 133*d* and 233*d* of the first address electrode 133 and the second address electrode 233 can have the same length.

Furthermore, the length of each of the vertical sides 133*d* of the first address electrode 133 and the vertical sides 233*d* of the second address electrode 233 is shorter than the length of the vertical sides 31*d* of the sustain electrode 31 and the length of the vertical sides 32*d* of the scan electrode 32. Additionally, the sum of the length of the vertical sides 133*d* of the first address electrode 133 and the length of the vertical sides 233*d* of the second address electrode 233 is smaller than the length of the vertical sides 31*d* of the sustain electrode 31 or the length of the vertical sides 32*d* of the scan electrode 32.

For this reason, the cross-section area of the first address electrode 133 is the same as that of the second address electrode 233. Each of the cross-section area of the first address electrode 133 and the cross-section area of the second address electrode 233 is smaller than that of the sustain electrodes 31 or the scan electrodes 32. Furthermore, the sum of the cross-section area of the first address electrode 133 and the cross-section area of the second address electrode 233 is smaller than the cross-section area of the sustain electrode 31 or the scan electrode 32.

The first address electrode 133 and the second address electrode 233 are disposed between the sustain electrode 31 and the scan electrode 32 being spaced apart from each other, and the second address electrode 233 is accordingly disposed close to the scan electrode 32. It is thus possible to lower an initial addressing firing voltage and thus to generate an address discharge at a low voltage. As priming particles formed by the address discharge are diffused into the sustain electrodes 31 and the scan electrodes 32, driving efficiency can be enhanced.

Furthermore, the first address electrode 133 and the second address electrode 233 have a relatively smaller cross-section area than that of the sustain electrodes 31 and the scan electrodes 32. Therefore, reactive power consumption between the address electrodes 33 disposed in the neighboring discharge cells 17 can be saved.

That is, capacitance (C) serving as reactive power consumption between the address electrodes 33 is in inverse proportion to a distance (d) between the neighboring address electrodes 33 and is in proportion to a cross-section area (S) of the address electrodes 33, assuming that the dielectric constant (∈) of a dielectric layer 34 is a constant, as in Equation 1. As described above, as the cross-section area (S) of the address electrodes 33 is reduced, the capacitance (C) between the address electrodes 33 is lowered.

$$C = \varepsilon \frac{S}{d} \quad \text{(Equation 1)}$$

Current (I) is in proportion to the capacitance (C), as in Equation 2. Therefore, as the capacitance (C) is lowered, the current (I) is lowered. Power consumption is in proportion to the current (I). Therefore, the lower the current (I), the lower the power consumption. As a result, reactive power consumption between the address electrodes 33 can be reduced and heat generated in the address electrodes 33 can be reduced.

$$C = \frac{\Delta Q}{\Delta V} = \frac{1}{\Delta V}\int I dt \quad \text{(Equation 2)}$$

The sustain electrodes 31, the scan electrodes 32, and the address electrodes 33 are buried within the dielectric layer 34 to form a mutual insulation structure. Therefore, the dielectric layer 34 forms the second discharge cells 37 surrounded by the electrodes 31, 32, and 33.

The dielectric layer 34 also accumulates wall charges thereon upon discharge. The dielectric layer 34 forms the second discharge cells 37 of the cylindrical shape, which correspond to the first discharge cells 27 formed in the barrier rib layer 26.

As the dielectric layer 34 forms the discharge cells 17 together with the barrier rib layer 26, the dielectric layer 34 is covered with protective layers 36 on the inner surfaces of the second discharge cells 37. In particular, the protective layers 36 can be formed in portions exposed to a plasma discharge occurring in the second discharge cells 37. The protective layers 36 protect the dielectric layer 34 and require a high secondary electron emission coefficient, but do not need to have transmittance of visible rays. That is, the electrodes 31, 32, and 33 are not formed in the front substrate 20 or the rear substrate 10, but are disposed between the substrates 10 and 20. The protective layers 36 coated on the dielectric layer 34 that buries the electrodes 31, 32, and 33 can be formed using a material having a non-transmittance characteristic of visible rays. Non-transparent MgO, as an example of the protective layers 36, has a much higher secondary electron emission coefficient value than that of transparent MgO, and can further lower the discharge firing voltage.

As discussed earlier, in accordance with the PDP according to the above-described embodiments of the present invention, the sustain electrodes, the first and second address electrodes, and the scan electrodes are disposed being spaced apart from one another between the rear substrate and the front substrate in a direction vertical to the planes of both the substrates, and surround the discharge cells at their sides. Therefore, the aperture ratio of the discharge cells or the transmittance of visible rays can be enhanced and brightness and luminous efficiency can be improved.

Furthermore, the first and second address electrodes have a cross-section area smaller than that of the scan electrodes or the sustain electrodes, and the area of the address electrodes is optimized, thus lowering capacitance between neighboring address electrodes. Therefore, the reactive power consumption between the address electrodes can be saved and heat generated in the address electrodes can be reduced.

Furthermore, as the address electrodes are separated into first and second address electrodes, an initial addressing firing voltage can be lowered. Therefore, an address discharge can be generated at a low voltage.

Furthermore, priming particles formed by the address discharge are diffused to the sustain electrodes and the scan electrodes through the first and second address electrodes. Therefore, efficiency of a PDP can be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A plasma display panel (PDP) comprising:

a first substrate and a second substrate opposite to each other with a distance therebetween;

a plurality of discharge cells partitioned between the first substrate and the second substrate;

first electrodes surrounding discharge cells of the plurality of discharge cells and proximate to one of the first substrate and the second substrate and between the first substrate and the second substrate, the first electrodes being connected in a first direction;

second electrodes spaced apart from the first electrodes along a direction perpendicular to planes of the first substrate and the second substrate and connected in the first direction, wherein the second electrodes surround discharge cells of the plurality of discharge cells and are proximate to the other of the first substrate and the second substrate; and a plurality of address electrodes spaced apart from the first electrodes and the second electrodes between the first electrodes and the second electrodes along the direction perpendicular to the planes of the first substrate and the second substrate, the plurality of address electrodes connected in a second direction crossing the first direction, wherein the address electrodes surround discharge cells of the plurality of discharge cells, wherein the plurality of address electrodes comprises:

first address electrodes proximate to the first electrodes; and second address electrodes spaced apart from the first address electrodes and proximate to the second electrodes.

2. The PDP of claim 1, wherein, in a cross-section along the direction perpendicular to the planes of the first substrate and the second substrate:

each of the first electrodes, the second electrodes, the first address electrodes, and the second address electrodes has a first side and a second side having a rectangular cross-sectional shape;

a length of each of the first sides of the first electrodes, the second electrodes, the first address electrodes, and the second address electrodes is the same; and a length of each of the second sides of the first address electrodes and the second address electrodes is shorter than a length of each of the second sides of the first electrodes and the second electrodes.

3. The PDP of claim 2, wherein a sum of the length of the second sides of the first address electrodes and the length of the second sides of the second address electrodes is smaller than the length of the second sides of the first electrodes or second sides of the second electrodes.

4. The PDP of claim 1, wherein, in a cross-section along the direction perpendicular to the planes of the first substrate and the second substrate, a cross-sectional area of each of the first address electrodes and the second address electrodes is smaller than a cross-sectional area of each of the first electrodes and the second electrodes.

5. The PDP of claim 1, wherein, in a cross-section along the direction perpendicular to the planes of the first substrate and the second substrate, the sum of a cross-sectional area of the first address electrodes and a cross-sectional area of the second address electrodes is smaller than a cross-sectional area of the first electrodes or a cross-sectional area of the second electrodes.

6. The PDP of claim 1, wherein the first address electrodes and the second address electrodes have a same shape.

7. The PDP of claim 1, wherein each of the first electrodes and the second electrodes comprises:

circular members surrounding the discharge cells; and connecting members connecting the circular members in the first direction.

8. The PDP of claim 7, wherein the address electrodes comprise:

circular members surrounding the discharge cells; and connecting members connecting the circular members in the second direction.

9. The PDP of claim 8, wherein the circular members of the first electrodes, the circular members of the plurality of address electrodes, and the circular members of the second electrodes are spaced apart from one another in parallel along the direction perpendicular to the planes of the first substrate and the second substrate.

10. The PDP of claim 1, wherein the first electrodes, the second electrodes, and the plurality of address electrodes are metal electrodes.

11. The PDP of claim 1, wherein the first electrodes, the second electrodes, and the plurality of address electrodes are within a dielectric layer.

12. The PDP of claim 11, wherein the dielectric layer is covered with protective layers on an inner surface of the discharge cells.

13. The PDP of claim 1, wherein:

the plurality of discharge cells are partitioned by a barrier rib layer between the first substrate and the second substrate; and an electrode layer formed of a dielectric layer surrounds the first electrodes, the plurality of address electrodes, and the second electrodes.

14. The PDP of claim 13, wherein:

the barrier rib layer is in the second substrate; and the electrode layer is between the baffler rib layer and the first substrate.

15. The PDP of claim 13, wherein the plurality of discharge cells have a cylindrical shape corresponding to an arrangement of the first electrodes, the plurality of address electrodes, and the second electrodes.

16. The PDP of claim 13, further comprising a phosphor layer inside each of the plurality of discharge cells partitioned by the barrier rib layer, wherein the phosphor layer is of a transmission type of phosphor.

17. An electrode layer for positioning between a first substrate and a second substrate in a plasma display panel, the electrode layer comprising: a dielectric layer having a plurality of openings defining discharge cells; first electrodes respectively surrounding each of the discharge cells and proximate to a first side of the dielectric layer, the first electrodes connected to each other in a first direction; second electrodes respectively surrounding each of the discharge cells and proximate to a second side of the dielectric layer, second side opposite to the first side, the second electrodes connected in the first direction; and address electrodes respectively surrounding each of the discharge cells, the address electrodes between and spaced apart from the first electrodes and the second electrodes and connected in a second direction crossing the first direction, wherein the address electrodes comprise: first address electrodes proximate to the first electrodes; and second address electrodes spaced apart from the first address electrodes and proximate to the second electrodes.

18. An electrode layer for positioning between a first substrate and a second substrate in a plasma display panel, the electrode layer comprising: a dielectric layer having a plurality of openings defining discharge cells; first electrodes respectively surrounding each of the discharge cells and proximate to a first side of the dielectric layer, the first electrodes connected to each other in a first direction; second electrodes respectively surrounding each of the discharge cells and proximate to a second side of the dielectric layer, second side opposite to the first side, the second electrodes connected in the first direction; and address electrodes respectively surrounding each of the discharge cells, the address electrodes between and spaced apart from the first electrodes and the second electrodes and connected in a second direction crossing the first direction, wherein each of the first electrodes, the second electrodes, and the address electrodes comprises: a circular member surrounding a respective one of the discharge cells; and a connecting member connecting the circular member to an adjacent circular member; wherein address electrodes respectively surrounding each of the discharge cells, the address electrodes between and spaced apart from the first electrodes and the second electrodes and connected in a second direction crossing the first direction.

* * * * *

UNITED STATES PATENT AND TRADEMARK OFFICE

CERTIFICATE OF CORRECTION

PATENT NO. : 7,453,209 B2
APPLICATION NO. : 11/407548
DATED : November 18, 2008
INVENTOR(S) : Tae-Joung Kweon It is certified that error appears in the above-identified patent and that said Letters Patent is hereby corrected as shown below:

| | |
|---|---|
| Column 11, line 19, Claim 14 | Delete "baffler",<br>Insert --barrier-- |

Signed and Sealed this

Second Day of June, 2009

JOHN DOLL
*Acting Director of the United States Patent and Trademark Office*